US008556623B2

(12) United States Patent
Guillou et al.

(10) Patent No.: US 8,556,623 B2
(45) Date of Patent: Oct. 15, 2013

(54) HAND TOOL WITH INCORPORATED BURNER AND A TRIGGER-PIEZOELECTRIC IGNITER UNIT WHICH MAY BE DISASSEMBLED

(75) Inventors: Yves Guillou, Chelles (FR); Christophe Le Drappier, Pantin (FR)

(73) Assignee: Guilbert Express, Fontenay sous Bois (FR)

( * ) Notice: Subject to any disclaimer, the term of this patent is extended or adjusted under 35 U.S.C. 154(b) by 348 days.

(21) Appl. No.: 12/786,652

(22) Filed: May 25, 2010

(65) Prior Publication Data

US 2010/0297567 A1 Nov. 25, 2010

(30) Foreign Application Priority Data

May 25, 2009 (FR) ..... 09 53423

(51) Int. Cl.
*F23Q 7/12* (2006.01)
*F23D 11/36* (2006.01)
*F23D 14/28* (2006.01)

(52) U.S. Cl.
USPC ..... 431/254; 431/255; 431/153; 431/344

(58) Field of Classification Search
USPC ..... 431/254, 255, 153, 344
See application file for complete search history.

(56) References Cited

U.S. PATENT DOCUMENTS 4,881,894 A * 11/1989 Chapin et al. ..... 431/255
4,920,951 A * 5/1990 Le Marchand et al. ..... 126/403
5,082,440 A * 1/1992 Yamamoto ..... 431/143
5,222,889 A * 6/1993 Hsu ..... 431/255
5,322,433 A * 6/1994 Shike et al. ..... 431/266
5,505,614 A * 4/1996 Lin ..... 431/143
5,531,592 A * 7/1996 Tasi ..... 431/255
5,564,919 A * 10/1996 Tsai ..... 431/255
5,573,393 A * 11/1996 Tsai ..... 431/255
5,697,775 A * 12/1997 Saito et al. ..... 431/153
5,741,128 A * 4/1998 Tsai ..... 431/255
5,897,308 A * 4/1999 Saito et al. ..... 431/153
5,967,768 A * 10/1999 Saito et al. ..... 431/153
6,196,833 B1 * 3/2001 Ho ..... 431/153
6,293,782 B1 * 9/2001 Tsai ..... 431/153
6,406,291 B2 * 6/2002 Ferrara et al. ..... 431/345
6,527,543 B2 * 3/2003 Tsai ..... 431/153
6,739,867 B2 * 5/2004 Puig-Gros ..... 431/153
6,979,190 B2 * 12/2005 Ichikawa et al. ..... 431/153
7,040,889 B2 * 5/2006 Tsai ..... 431/255
7,175,425 B2 * 2/2007 Sung ..... 431/153
7,699,601 B2 * 4/2010 Aronson et al. ..... 431/153
2009/0075221 A1 3/2009 Bouvier et al.
2010/0081105 A1 4/2010 Guillou et al.

FOREIGN PATENT DOCUMENTS

CN 101392907 3/2009
DE 43 20 299 12/1993
DE 44 45 587 7/1995

(Continued)

*Primary Examiner* — Kenneth Rinehart
*Assistant Examiner* — William Corboy
(74) *Attorney, Agent, or Firm* — Harness, Dickey & Pierce, P.L.C.

(57) ABSTRACT

The disclosure relates to a hand tool with an incorporated burner comprising:

a casing;

a burner housed in the casing and connected to an electrically conducting component;

a trigger apt to move on the casing;

an ignition abutment; and a piezoelectric igniter;

wherein the trigger and the piezoelectric igniter form a unit which may be disassembled by detachment of the trigger from the casing.

8 Claims, 5 Drawing Sheets

(56) References Cited

FOREIGN PATENT DOCUMENTS

| | | |
|---|---|---|
| EP | 0 678 240 | 10/1995 |
| EP | 0 885 682 | 12/1998 |
| EP | 1 795 803 | 6/2007 |
| EP | 2 169 309 | 3/2010 |
| FR | 2 718 922 | 10/1995 |
| FR | 2 721 799 | 1/1996 |
| FR | 2 743 981 | 8/1997 |
| FR | 2 751 053 | 1/1998 |
| FR | 2 859 120 | 3/2005 |

* cited by examiner

HAND TOOL WITH INCORPORATED BURNER AND A TRIGGER-PIEZOELECTRIC IGNITER UNIT WHICH MAY BE DISASSEMBLED

CROSS-REFERENCE TO RELATED APPLICATIONS

This application claims the benefit and priority of French Application 0953423, filed on May 25, 2009, which is incorporated by reference herein.

FIELD OF THE INVENTION

The invention relates to the field of hand tools with an incorporated burner comprising:

a casing, a burner housed in the casing and connected to an electrically conducting component;

a trigger apt to move on the casing;

an ignition abutment; and a piezoelectric igniter.

The piezoelectric igniter is positioned against the ignition abutment and the trigger will exert pressure on the piezoelectric igniter, thereby polarizing the latter.

BACKGROUND

In certain conventional hand tools with a burner, the casing comprises a housing receiving a piezoelectric igniter. In other ones, the piezoelectric igniter is mounted on other components present inside the casing. Thus, the casing is of complex design since it has to provide the housing for parts such as a piezoelectric igniter, a burner . . . .

Also, upon manufacturing the hand tool, the casing, generally in two portions held together by an attachment of the screwing or snapping-on type, should be opened for attaching or positioning the piezoelectric igniter. Also, when the piezoelectric igniter is damaged or worn out, its replacement requires disassembly of the hand tool and at least opening of the casing. This disassembly then forces the user to proceed with a relatively consequent number of operations and possibly requires the use of tools such as screwdrivers, wrenches, and the like.

Although this disassembly may be performed in the workshop, it is sometimes a source of handling problems on the worksite. For example, for roofing work, the workman is located on the roof and is therefore in a not very suitable position for disassembling a hand tool (risk of dropping the screwdriver, wrenches, components of the hand tool or other tools). Also, it is common that the workman dealing with roofing only takes onto the roof the tools which are strictly required for the roofing operation. The necessity to climb down to fetch a tool required for disassembling the hand tool and for replacing the faulty piezoelectric igniter is therefore a problem for this workman.

SUMMARY

The object of the invention is therefore to overcome at least one of the above drawbacks. To this aim, the invention provides a hand tool with an incorporated burner comprising:

a casing;

a burner housed in the casing and connected to an electrically conducting component;

a trigger mounted on the casing and movable along an axis;

an ignition abutment; and a piezoelectric igniter;

wherein the trigger comprises an open actuation housing receiving the piezoelectric igniter, said actuation housing having an open end facing the ignition abutment so that the piezoelectric igniter is placed facing the ignition abutment and that a displacement of the trigger in an actuation direction forces the piezoelectric igniter against the ignition abutment for producing a spark at the burner via the electrically conducting component;

and wherein the trigger and the piezoelectric igniter form a take-down unit, the take-down unit being removable from the casing without opening of the casing.

An advantage of the hand tool with incorporated burner according to the invention is to facilitate the design of the casing in which there is no need to provide a housing for holding the piezoelectric igniter. Other optional and non-limiting features are:

trigger and the casing comprise mechanical element with shape complementarity which are separable by elastic deformation;

the casing comprises a handle and an orifice at the handle receiving the trigger;

the mechanical element with shape complementarity provided on the trigger is at least one guiding knob;

the mechanical element with shape complementarity provided on the casing comprises at least one inner groove at the handle and opening onto the orifice receiving the trigger, at a mouth and a blocking protrusion in the groove and near the orifice;

the guiding knob being located in the inner groove on the side opposite to the mouth relatively to the protrusion;

the guiding knob and the protrusion being configured to elastically cooperate so that a stress exerted on the guiding knob towards the protrusion enables separation of the trigger from the casing;

the trigger further comprises a reserve housing in order to receive a second piezoelectric igniter;

the casing comprises a barrel and at least one first guide at the barrel for guiding the trigger in its displacement; the trigger comprises at least one second guide for cooperating with the first guide of the casing;

a displacement of the trigger in the actuation direction along the first guide for bringing the piezoelectric igniter closer to the ignition abutment, and a displacement of the trigger in a direction opposite to the actuation direction along the first guide being capable of enabling the trigger to be separated from the casing;

the hand tool further comprises a removable lance comprising a cooperating portion that cooperates with the casing for the assembling and disassembling of the lance onto the casing; and the lance also comprises an abutment which, upon contact with the trigger, prevents the trigger from being separated from the casing;

the lance further comprises a cooperating portion that cooperates with the trigger for locking when it is not operating or unlocking the trigger, wherein the cooperating portion of the lance:

prevents, upon locking when in an inoperative mode, the displacement of the trigger in the actuation direction by mechanical abutment; and releases, during unlocking, the displacement of the trigger in the actuation direction for bringing the ignition abutment and the piezoelectric igniter into contact;

the cooperating portion of the lance comprises a rotary ring about the axis of the lance, and the section of which has a blocking portion and an unblocking portion, the blocking portion extending radially beyond the unblocking portion on a fraction of the ring less than 360° so as to come into abutment with a blocking wedge provided on the trigger during locking;

the casing comprises a stopping wedge, the trigger comprises an operating lock, an instantaneous actuation portion for instantaneous operation of the hand tool and a locking actuation portion for a locking operation of the hand tool, the actuation of the instantaneous actuation portion driving the operating lock along the axis of displacement of the trigger; and the locking of the actuation portion driving the operating lock into motion towards the stopping wedge and thereby locking the hand tool in an operative state;

the groove is parallel to the axis of displacement of the trigger; the actuation portions are actuated by pressure; the instantaneous actuation portion is located facing to the groove; the locking actuation portion is located so that an imaginary line connecting locking actuation portion and the knob form an angle with the groove.

Another advantage of the hand tool with incorporated burner according to the invention is that replacing the faulty piezoelectric igniter only requires the user to disassemble the trigger, a much easier operation than opening the casing, often in two portions which are connected together in several points. This operation is performed without any tool.

BRIEF DESCRIPTION OF THE DRAWINGS

Other features, objects and advantages will become apparent from reading the following detailed description, with reference to the drawings given as an illustration and not as a limitation, among which.

DETAILED DESCRIPTION

Removable Trigger and Piezoelectric Igniter

Figure 1:
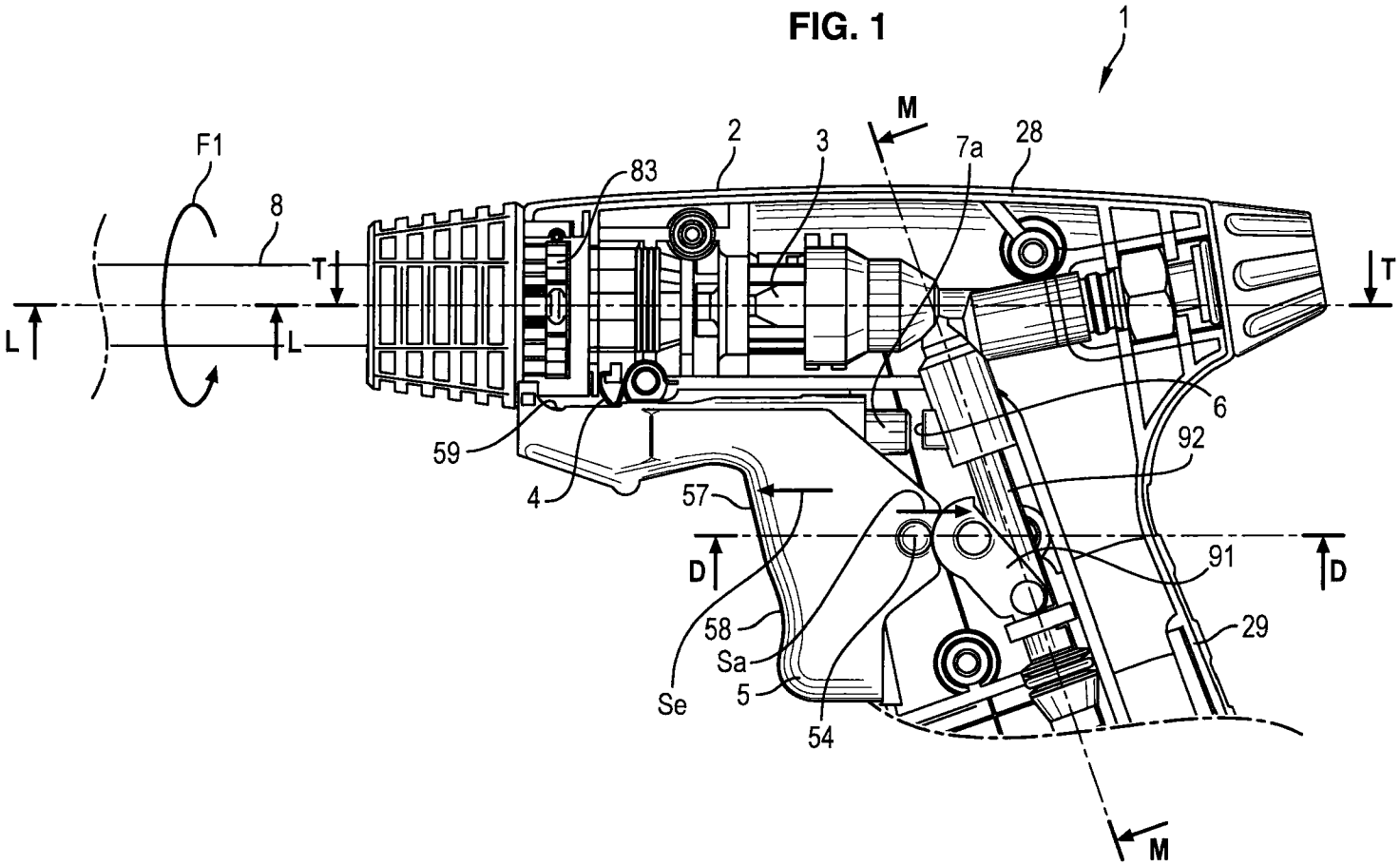
FIG. 1 is a side view of the hand tool according to the invention in which a portion of the casing has been removed in order to show the trigger mounted on the casing.

A hand tool with an incorporated burner is described hereafter, with reference to FIGS. 1-5. The hand tool 1 with an incorporated burner 3 may be a soldering lamp, a blowtorch, a burner, a hot air generator, a soldering iron, a barking iron, or any other heating device by flame or by contact. For the sake of clarity, the description hereafter may sometimes be made with reference to a soldering lamp. This choice should not be understood as a limitation of the invention but one skilled in the art will be able to transpose this description to other hand tools mentioned in the previous paragraph.

The hand tool 1 comprises according to the invention:

a casing 2;

a burner 3 housed in the casing 2 and connected to an electrically conducting component 4;

a trigger 5 apt to move on the casing 2 along the axis D-D;

an ignition abutment 6; and a piezoelectric igniter 7*a*.

The casing 2 may be in two joined portions and held together by screwing or snapping-on means. The juncture plane is a plane parallel to the sectional planes of the figures.

The casing 2 comprises a barrel 28 and a handle 29 laid out relatively to each other so that their respective axes T-T, M-M, form a preferably non-zero angle. By "barrel" is understood a hollow axisymmetrical portion (around the axis T-T) of the casing 2 for housing hand tool 1 components. The casing 2 has an orifice 22 where the barrel 28 and the handle 29 join. This orifice 22 extends between the barrel 28 and the handle 29 and is adapted so as to receive the trigger 5. At the barrel 28, the orifice 22 extends parallel to the axis T-T of the barrel forming a barrel portion 22*t*. At the handle, the orifice extends parallel to the M-M axis of the handle forming a handle portion 22*m*.

When the user wishes to operate the hand tool 1, he/she actuates the trigger 5. For example he/she presses on the trigger 5 so that the latter moves along the barrel portion 22*t* of the orifice 22 (i.e. parallel to the axis T-T of the barrel) and enters further into the casing 2 with the handle portion 22*m* of the orifice 22. Actuation of the trigger 5 causes a displacement of the piezoelectric igniter 7*a* towards the ignition abutment 6, in a actuation direction referenced as Sa.

During the displacement of the piezoelectric igniter 7*a* towards the ignition abutment 6, the piezoelectric igniter 7*a* comes into contact with the ignition abutment 6. Next, an additional displacement of the igniter 7*a* always in the same direction Sa, causes compression of the igniter 7*a* since the latter is stressed by the ignition abutment 6. The compression of the piezoelectric igniter 7*a* causes its electric polarization between a part in contact with the ignition abutment 6 and a part in contact with the blade 4, which enables a spark to be produced at the burner 3 via the electrically conducting component 4 placed between the burner 3 and the piezoelectric igniter 7*a*.

Meanwhile, in an exemplary hand tool 1, during displacement of the trigger 5 driving the igniter 7*a* towards the ignition abutment 6, the trigger 5 actuates a connecting rod 91 linked to a transmitter 92. The transmitter 92 is an elongated component reciprocating between an expansion valve 93 incorporated into the hand tool 1 and an orifice 94 for releasing combustible gas. The transmitter 92 comprises a channel 921 for transmitting gas in order to bring the combustible gas up to an aperture 922 opening out radially. A spring 95 forces the transmitter 92 against a valve seat 98 associated with the release orifice 94. Two O-ring gaskets 96, 97 on either side of the aperture 922 and on the transmitter 92 ensure sealing at the release orifice 94 when the transmitter 92 is forced against the valve seat 98 associated with the release orifice 94. With the connecting rod 91, it is possible to transform a displacement along an axis into a displacement along another axis. Thus, the actuated connecting rod 91 translates the transmitter 92 so as to move it away from the valve seat 98 associated with the release orifice 94. Combustible gas may then escape from the aperture 922 of the transmitter 92 towards the release orifice 94 feeding the burner 3.

When the user stops actuating the trigger 5, elastic return means of the trigger 5 bring the trigger 5 back to its rest position. For example, the elastic return means are the spring 95 and the piezoelectric igniter 7*a*. The spring 95 acts on the transmitter 92 in order to bring the latter to its starting position, i.e. it is stressed against the seat valve 98. The return of the transmitter 92 to its starting position also causes the connecting rod 91 to return to its starting position and the latter then acts on the trigger 5. Thus, the piezoelectric igniter 7*a* comprises a spring which exerts a force opposite to the compression force exerted by the trigger 5 onto the piezoelectric igniter 7*a*. This opposite return force contributes in bringing the trigger 5 back to its starting position. Thus, for example, a difference in cross-section between the outlet of the expansion valve 93 and the gasket 97 acts together with the spring 95 in order to bring the transmitter 92 back to its starting position. Indeed, since the same pressure prevails between the outlet of the expansion valve 93 (smaller section) and the gasket 97 (larger section) a force is generated which tends to bring the transmitter 92 back to its starting position.

The trigger 5 comprises an open actuation housing 51 receiving the piezoelectric igniter 7*a*. The trigger 5 and the piezoelectric igniter 7*a* then form a unit 5-7*a* which may be disassembled by detaching the trigger 5 from the casing 2. Said actuation housing 51 has an open end facing the ignition abutment 6 so that the piezoelectric igniter 7*a* is placed facing the ignition abutment 6. Thus, displacement of the trigger 5 can force the piezoelectric igniter 7*a* against the ignition abutment 6 in order to produce a spark at the burner 3 via the electrically conducting component 4 as described above.

Thus, when the piezoelectric igniter 7*a* is faulty, the user does not need to open the casing 2 for replacing the piezoelectric igniter 7*a*. He/she only has to extract the trigger 5 from the casing 2, thanks to separable mechanical elements with shape complementarity, and consequently extracting the piezoelectric igniter 7*a* out of the casing 2. Thus, he/she does not need any tool.

In order to ease separation of the trigger from the casing, the trigger 5 and the casing 2 comprise mechanical elements with shape complementarity which are separable by elastic deformation. For example, the mechanical elements with shape complementarity provided on the trigger 5 are at least one guiding knob 54. The mechanical elements with a shape complementarity provided on the casing 2 comprise at least one groove 24 and a blocking protrusion 23. The groove 24 is made inside the handle 29 and opens onto the handle portion 22*m* of the orifice 22 receiving the trigger 5 at an opening 22*e*. The blocking protrusion 23 is made in the groove 24 and near the handle portion 22*m* of the orifice 22.

When the trigger 5 is mounted on the casing 2, the guiding knob 54 is located in the inner groove 24 on the opposite side to the opening 22*e* relatively to the protrusion 23. The knob 54 and the protrusion 23 are adapted so as to elastically cooperate so that a stress exerted on the knob 54 towards the protrusion 24 separates the trigger 5 from the casing 2. The blocking protrusion 23 is a hard point providing limitation of the movement of the trigger 5 in order to avoid its separation or detachment from the casing 2 when this is not desired by the user.

The separable mechanical elements with shape complementarity enable the trigger 5 to be separated from the casing 2 without needing a tool. Also, with them, it is possible to prevent a displacement of the trigger 5 in a direction Se opposite to the actuation direction Sa from causing separation of the trigger 5 from the casing 2 when this is not desired by the operator, for example in an operating mode.

The groove 24 may be provided parallel to the axis D-D of the displacement of the trigger 5. In this casing, the knob 54 slides in the groove 24 on the side opposite to the opening 22*e* relatively to the groove 24. The movement of the trigger 5 is limited by the blocking protrusion 23 and the piezoelectric igniter 7*a* which has determined compressive amplitude.

The trigger 5 may also comprise a reserve housing 52 for receiving a second piezoelectric igniter 7*b*. Thus, during a failure of the first piezoelectric igniter 7*a*, which is naturally unpredictable, the user will have a new piezoelectric igniter 7*b* available. Therefore, he/she does not have to leave his/her work position in order to fetch a new piezoelectric igniter 7*b* in the middle of a task. It will be sufficient for him/her to extract the first piezoelectric igniter 7*a* from the actuation housing 51 in order to place the second reserve piezoelectric igniter 7*b* in the actuation housing 51. Next, he/she may, once his/her task is completed, or at the end of a working day, put a new piezoelectric igniter back into the reserve housing 52.

Figure 5:
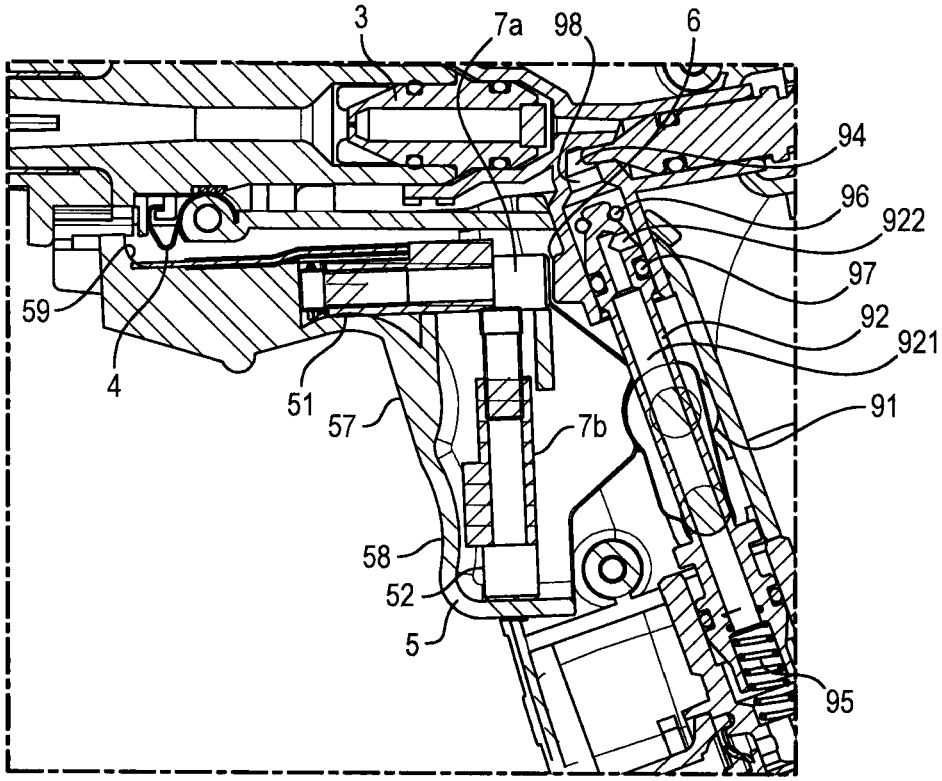
FIG. 5 is a longitudinal sectional view of the trigger mounted on the casing.

The reserve housing 52 does not require any particular configuration if only enabling the second piezoelectric igniter 7*b* to remain unstressed during the whole handling of the hand tool 1. For example, as illustrated in FIG. 5, the actuation housing 51 is longitudinal and provided parallel to the displacement of the trigger 5, while the reserve housing 52, also longitudinal, is provided substantially perpendicularly to the actuation housing 51.

For guiding the trigger 5 on the casing 2, the casing 2 may comprise a first guide 21 at the barrel 28. The trigger 5 may comprise at least a second guide in order to cooperate with the first guide 21 of the casing 2. A displacement in the actuation direction Sa along the first guide 21 brings the piezoelectric igniter 7*a* closer to the ignition abutment, and a displacement in the direction Se opposite to the actuation direction Sa along the first guide 21 enables the trigger 5 to be separated from the casing 2 as already described above.

More specifically, in the direction Se, the movement of the trigger 5 is not limited by the casing 2; the casing 2 opens out at least partly on this side. The first guide 21 may be a rail, a groove, a recess or a throat; the means for guiding the trigger 5 may be a groove, a rib, a protrusion or a throat respectively; and vice versa.

The displacement of the trigger 5 may be substantially rectilinear. In this case, the first guide 21 and the second guide are also rectilinear. This enables a simple gesture for disassembling the trigger 5. For example, simple translation of the trigger 5 is required.

The hand tool 1 may further comprise a lance 8 which may be disassembled, comprising a cooperating portion that cooperates with the casing 2 for its assembling and disassembling on the casing 2, for example by shape complementarity. The lance 8 comprises an abutment 82 which in contact with the trigger 5 prevents the latter from being separated from the casing 2. The abutment 82 may be a radial finger. The lance 8 delimits a space in which the flame produced by the burner 3 is contained. The lance 8 may also delimit a space in which air is heated by the flame produced by the burner 3.

The hand tool 1 may then comprise one or two components with which the movement of the trigger 5 may be delimited in order to avoid its separation from the casing 2 when this is not desired by the user: on one side there is the protrusion 23 acting as a hard point and on the other side there is the abutment 82 of the lance 8.

Example of Disassembling the Trigger-Piezoelectric Igniter Assembly

FIG. 1 illustrates a hand tool 1, for example a soldering lamp, with the trigger-piezoelectric igniter unit 5-7*a* mounted on the casing 2. In this configuration, the abutment 82 of the lance 8 prevents the unit 5-7*a* from being separated from the casing 2.

Figure 2:
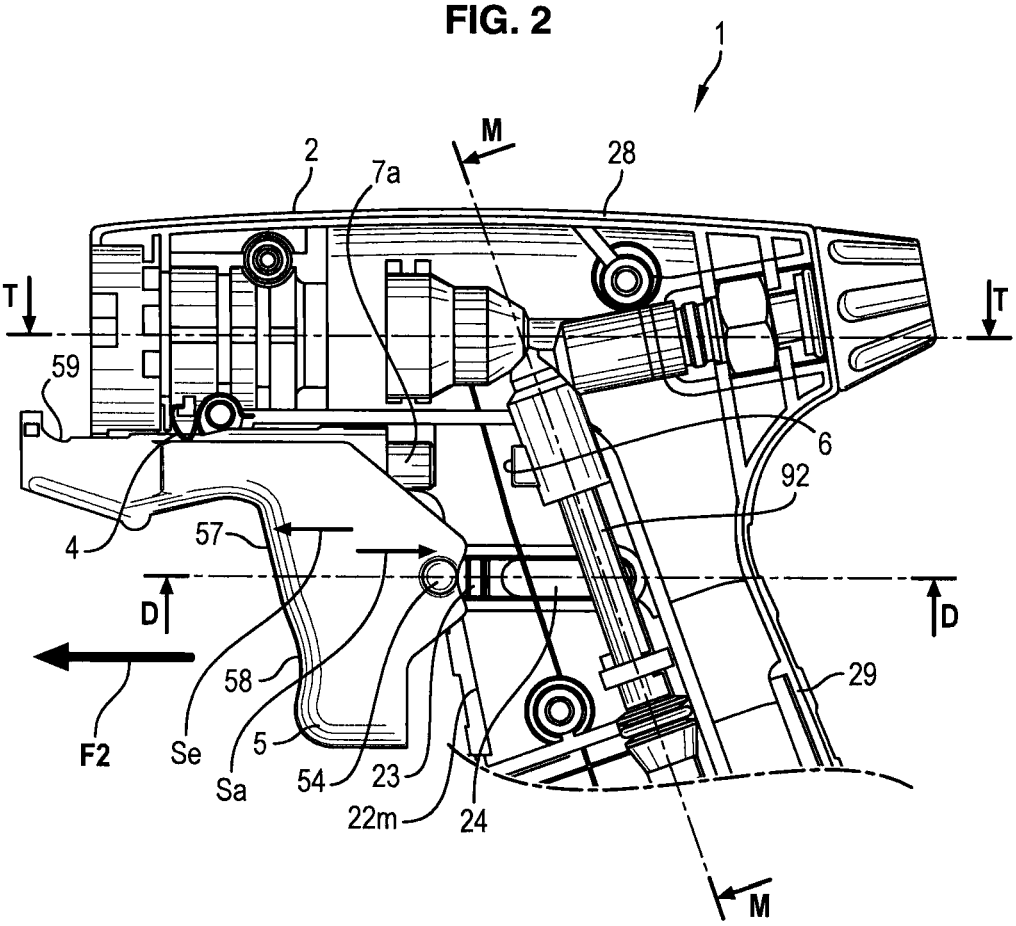
FIGS. 2, 3 and 4 are side views of the hand tool according to the invention, wherein a portion of the casing has been removed and showing different steps for disassembling the trigger.

In order to separate or disassemble this trigger-piezoelectric igniter unit 5-7*a*, the user has first of all to disassemble the lance 8 of the casing, for example with a quarter turn as indicated by the arrow F1. For other tools, it is possible that the lance 8 is absent, in which casing this step does not take place. Once the lance 8 is disassembled, in order to separate the unit 5-7*a* it is sufficient to extract it according to a rectilinear movement as indicated by the arrow F2, i.e. according to the direction Se moving the piezoelectric igniter 7*a* away from the ignition abutment 6, as illustrated in FIG. 2.

During this rectilinear movement along the arrow F2, the guiding knobs 54 move along the internal guiding assemblies 24 until they come into contact with the blocking protrusions 23. The user then has to exert an additional stress on the trigger 5 in the direction of the arrow F2. This additional stress is transmitted to the guiding knobs 54 which cross the blocking protrusions 23 towards the opening 22*e* as a result of an elastic deformation either of the guiding knobs 54 or of the blocking protrusions 23, or of both of them.

It is possible to provide a hand tool wherein, when the trigger is in the rest position, the guiding knobs 54 are already in contact with the blocking protrusions 23. In which case, there is no need for translating the guiding knob 54 in the direction of the arrow F2 beforehand. It is possible to only provide this step required for separating the trigger-piezoelectric igniter unit 5-7*a* i.e. once the guiding knobs 54 have passed over the blocking protrusions 23 towards the handle portion 22*m* of the orifice 22 receiving the trigger 5, the trigger-piezoelectric igniter unit 5-7*a* is separated from the casing 2.

Figure 3:
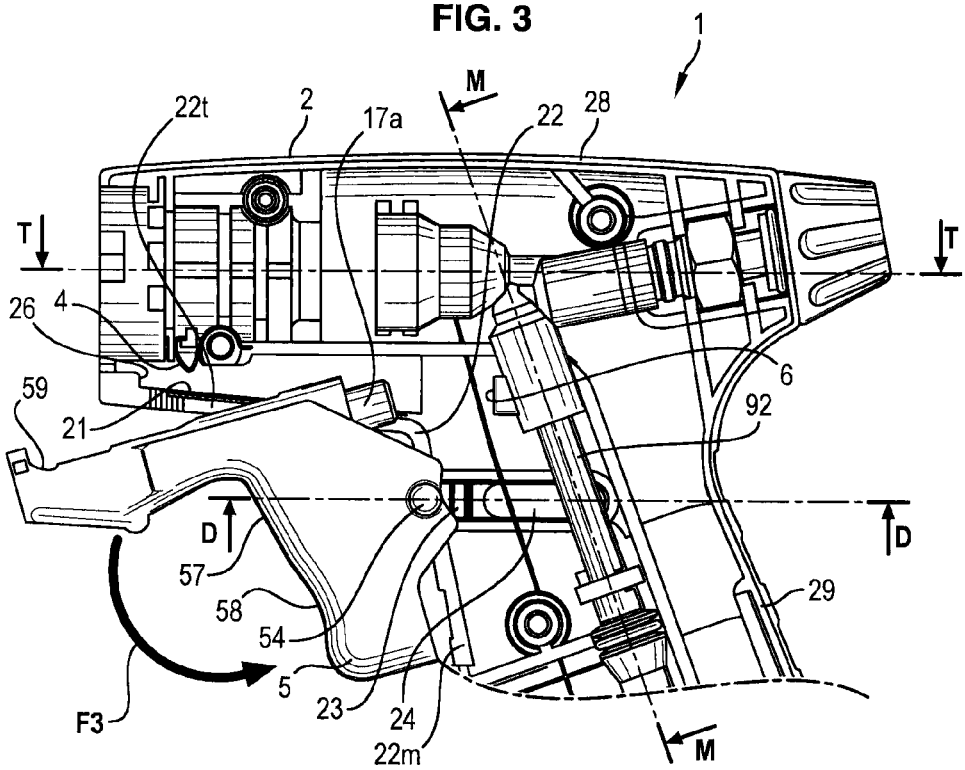

In other cases, for example for reasons of bulkiness of the hand tool 1, the design of the hand tool 1 requires that once the guiding knobs 54 have crossed the blocking protrusions 23 towards the handle portion 22*m* of the orifice 22 receiving the trigger 5, the trigger-piezoelectric igniter unit 5-7*a* has to be pivoted according to the arrow F3 so as to be able to extract the trigger-piezoelectric igniter unit 5-7*a* as illustrated in FIG. 3. Indeed, this movement may be necessary because a displacement of the trigger-piezoelectric igniter unit 5-7*a* always in the direction of the arrow F2 as in FIG. 2 may lead to that the piezoelectric igniter 7*a* will abut against another component comprised in the casing 2 or against the casing 2 itself. For example, in the case illustrated in FIG. 3, this pivoting movement is necessary because the piezoelectric igniter 7*a* comes and abuts against the electrically conducting component 4.

Figure 4:
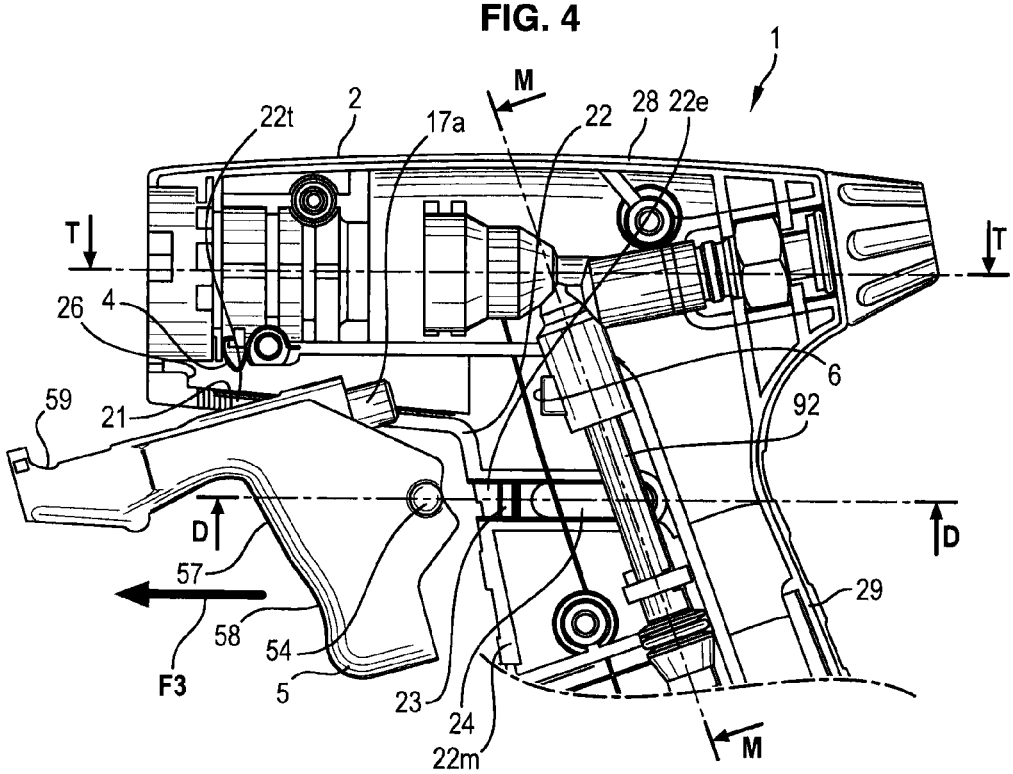

Finally, by displacement of the trigger-piezoelectric igniter unit 5-7*a* according to the arrow F4, it is possible to complete extraction of the trigger-piezoelectric igniter unit 5-7*a* from the casing 2, as illustrated in FIG. 4. The mounting of the trigger-piezoelectric igniter unit 5-7*a* is carried out by following the same steps as described above, in the reverse order of the separation or disassembly.

A Trigger Enabling Different Operating Modes

Figure 6:
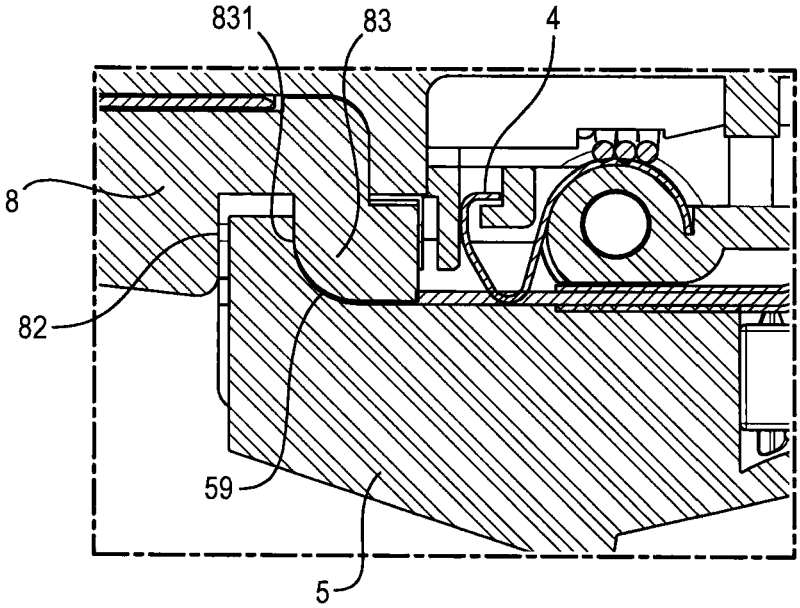
FIG. 6 is a longitudinal sectional view enlarged relatively to FIG. 5 of a portion of the trigger facing the lance in the blocking mode when in an inoperative mode.
Figure 8:
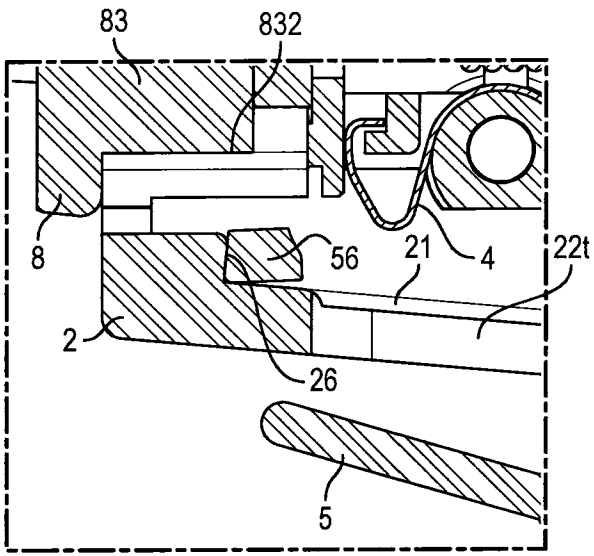
FIG. 8 is a sectional view enlarged relatively to FIG. 5 of a portion of the trigger facing the lance in the locking actuation mode, the sectional plane being parallel and different from FIGS. 5 and 6.
Figure 7:
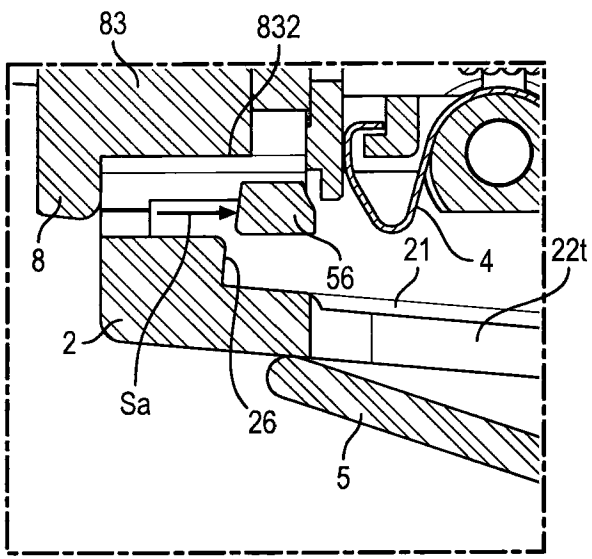
FIG. 7 is a sectional view, enlarged relatively to FIG. 5, of a portion of the trigger facing the lance in the instantaneous actuation mode, the sectional plane being parallel and different from FIGS. 5 and 6.

The trigger 5 of the hand tool 1 according to the invention also enables several modes for operating the hand tool 1 which are described hereafter with reference to FIGS. 6-8. In the case of a hand tool 1 comprises a lance 8, the latter may further comprise cooperating portion 83 that cooperates with the trigger 5 for the blocking when in an inoperative mode or the unblocking.

The cooperating portion 83 prevents, in blocking when in an inoperative mode, displacement of the trigger 5 towards the ignition abutment. Upon unblocking, they enable displacement of the trigger 5 towards the ignition abutment in order to bring the latter and the piezoelectric igniter 7*a* into contact.

For example, as illustrated in FIGS. 6-8, the cooperating porting 83 of the lance 8 are a rotary ring 83 about the axis L-L (see FIG. 1) of the lance 8. The section of the ring 83 has a blocking portion 831 and an unblocking portion 832. The blocking portion 831 extends radially beyond the unblocking portion 832 and on a limited angular portion in order to come into abutment with a blocking wedge 59 interdependent on the trigger 5 in a blocking mode, when in an inoperative mode. The rotation of the ring 83 enables shifting from the blocking mode when in an inoperative mode (FIG. 6) to the unblocking mode (or operating mode, FIGS. 7 and 8). i.e., by rotating the ring 83, it is possible to position either the blocking portion 831 in front of the blocking wedge 59 of the trigger 5 thereby preventing a movement of the trigger 5 along the actuation direction Sa (see FIG. 1); or the unblocking portion 832 facing the wedge 59 for blocking the trigger 5 thereby releasing the movement of the trigger 5 along the actuation direction Sa.

The casing 2 may also comprise a stopping wedge 26 and the trigger 5 a operating lock 56 during operation, an instantaneous operation portion 57 for instantaneously operating the hand tool 1 (FIG. 7) and a locking actuation portion 58 for a locking operation of the hand tool 1 (FIG. 8). When the trigger 5 is associated with the casing 2, the operating lock 56 is positioned above the stopping wedge 26 along an axis perpendicular to the axis D-D of displacement of the trigger 5.

The instantaneous actuation portion 57 is adapted so that when the user exerts pressure on the latter, and then releases the pressure, the operating lock 56 moves along the axis D-D of displacement of the trigger 5, and never encounters the stopping wedge 26. A combustion gas is then released at the burner 3 during the instant comprised between the moment when the instantaneous actuation portion 57 is driven in and the moment when it is released. When the user exerts pressure on the actuation portion 57, the trigger 5 sinks into the casing 2, for example in the actuation direction Sa (FIG. 1). When the user releases the pressure, the trigger 5 moves back to its initial position of before the pressure, by the action of the elastic return component of the trigger 5, for example the trigger 5 moves in the direction Se (FIG. 1).

The locking actuation portion 58 is adapted so that when the user exerts pressure on the latter, the operating lock 56 moves in the actuation direction Sa and downwards. When the user releases the pressure on the locking actuation portion 58, the operating lock 56 moves in the direction Se opposite to the actuation direction Sa, by the action of the elastic return component of the trigger 5, and will come into contact with the stopping wedge 26 thereby locking the hand tool 1 when operating. When the user exerts pressure on the locking actuation portion 58, the trigger 5 sinks into the casing 2. When the user releases the pressure on the locking actuation portion 58, the trigger 5 remains locked in a sunken-in position.

In order to unlock the trigger 5, the user then exerts pressure on the instantaneous actuation portion 57 which displaces the operating lock 56 away from the stopping wedge 26 in the actuation direction Sa and upwards. The trigger 5 then moves back to its initial position by action of the elastic return component of the trigger 5. Alternatively, a push-button is provided on the hand tool 1 and adapted for displacing the operating lock 56 out of the stopping wedge 26, this push-button displaces the operating lock 56 away from the stopping wedge 26 in the actuation direction Sa and upwards. The user will only have to press on this button in order to return the trigger 5 to its initial position.

Thus, the user is not forced to hold the trigger 5 during prolonged use of the hand tool 1. Further, the fact that the methods of use during instantaneous actuation or locking may be selected by exerting pressure on different portions of the trigger 5 enables the user to pass from mode to the other easily. Also, the user only needs one hand and one single movement for being able to use the hand tool 1 in the locking actuation mode.

In a particular exemplary hand tool 1, the groove 24 is parallel to the axis D-D of displacement of the trigger 5. The instantaneous actuation portion 57 is located facing the groove 24. Thus, when the user exerts pressure on this instantaneous actuation portion 57, the trigger performs simple translation along the axis D-D, as well as the operating lock 56.

The locking actuation portion 58 is located so that an imaginary line connecting the locking actuation portion 58 and the knob 24 form an angle with the groove 24. Thus, when the user exerts pressure on this locking actuation portion 58, the knob 24 is used as a pivot for the pivoting movement; the operating lock 56 moves downwards.

The invention claimed is:

1. A hand tool with an incorporated burner comprising:
a casing;
a burner housed in the casing and connected to an electrically conducting component;
a trigger mounted on the casing and movable along an axis;
an ignition abutment; and
a piezoelectric igniter;
wherein the casing comprises a handle and an orifice extending in the handle and receiving the trigger;
wherein the trigger comprises an open actuation housing receiving the piezoelectric igniter and a reserve housing in order to receive a second piezoelectric igniter;
the actuation housing having an open end facing the ignition abutment so that the piezoelectric igniter is placed facing the ignition abutment and that a displacement of the trigger in an actuation direction forces the piezoelectric igniter against the ignition abutment for producing a spark at the burner via the electrically conducting component;
wherein the displacement of the trigger causes the combustion gas to be released; and
wherein the trigger and the piezoelectric igniter form a take-down unit, the take-down unit being removable from the casing without opening of the casing.

2. A hand tool with an incorporated burner comprising:
a casing;
a burner housed in the casing and connected to an electrically conducting component;
a trigger mounted on the casing and movable along an axis;
an ignition abutment; and
a piezoelectric igniter;
wherein the casing comprises a handle and an orifice extending in the handle and receiving the trigger;
wherein the trigger comprises an open actuation housing receiving the piezoelectric igniter;
the actuation housing having an open end facing the ignition abutment so that the piezoelectric igniter is placed facing the ignition abutment and that a displacement of the trigger in an actuation direction forces the piezoelectric igniter against the ignition abutment for producing a spark at the burner via the electrically conducting component;
wherein the displacement of the trigger causes the combustion gas to be released; and
wherein the trigger and the piezoelectric igniter form a take-down unit, the take-down unit being removable from the casing without opening of the casing; and
wherein:
the casing comprises a barrel and at least one first guide at the barrel cooperating with the trigger and guiding the trigger in its displacement;
a displacement of the trigger in the actuation direction along the first guide for bringing the piezoelectric igniter closer to the ignition abutment; and
a displacement of the trigger in a direction opposite to the actuation direction along the first guide being capable of enabling the trigger to be separated from the casing.

3. A hand tool with an incorporated burner comprising:
a casing;
a burner housed in the casing and connected to an electrically conducting component;
a trigger mounted on the casing and movable along an axis;
an ignition abutment; and
a piezoelectric igniter;
wherein the casing comprises a handle and an orifice extending in the handle and receiving the trigger;
wherein the trigger comprises an open actuation housing receiving the piezoelectric igniter;
the actuation housing having an open end facing the ignition abutment so that the piezoelectric igniter is placed facing the ignition abutment and that a displacement of the trigger in an actuation direction forces the piezoelectric igniter against the ignition abutment for producing a spark at the burner via the electrically conducting component;
wherein the displacement of the trigger causes the combustion gas to be released;
wherein the trigger and the piezoelectric igniter form a take-down unit, the take-down unit being removable from the casing without opening of the casing;
wherein the trigger and the casing comprises mechanical elements with shape complementarity and which are separable by elastic deformation;
wherein the mechanical elements with shape complementarity comprise at least one guiding knob provided on a first of the trigger and the casing and at least one groove with a blocking protrusion in the groove provided on a second one of the trigger and the casing; and
the guiding knob being located in the groove and the guiding knob and the protrusion being configured to elastically cooperate so that a stress exerted on the guiding knob towards the protrusion enables separation of the trigger from the casing.

4. The hand tool according to claim 1, wherein
the mechanical element with shape complementarity provided on the trigger is the at least one guiding knob; and wherein
the mechanical element with shape complementarity provided on the casing comprises the at least one groove as at least one inner groove at the handle and opening onto the orifice receiving the trigger, at a mouth and the blocking protrusion near the orifice;
the guiding knob being on the side opposite to the mouth relative to the protrusion.

5. The hand tool according to claim 4, wherein the casing comprises a stopping wedge, the trigger comprises an operating lock, an instantaneous actuation portion for instantaneous operation of the hand tool and a locking actuation portion for a locking operation of the hand tool;
the actuation of the instantaneous actuation portion driving the operating lock along the axis of displacement of the trigger; and
the locking of the actuation portion driving the operating lock into motion towards the stopping wedge and thereby locking the hand tool in an operative state;

wherein the groove is parallel to the axis of displacement of the trigger;

wherein the actuation portions are actuated by pressure;

wherein the instantaneous actuation portion is located facing to the groove; and wherein the locking actuation portion is located so that an imaginary line connecting locking actuation portion and the knob form an angle with the groove.

6. A hand tool with an incorporated burner comprising:

a casing;

a burner housed in the casing and connected to an electrically conducting component;

a trigger mounted on the casing and movable along an axis;

an ignition abutment; and a piezoelectric igniter;

wherein the trigger comprises an open actuation housing receiving the piezoelectric igniter;

the actuation housing having an open end facing the ignition abutment so that the piezoelectric igniter is placed facing the ignition abutment and that a displacement of the trigger in an actuation direction forces the piezoelectric igniter against the ignition abutment for producing a spark at the burner via the electrically conducting component;

wherein the trigger and the piezoelectric igniter form a take-down unit, the take-down unit being removable from the casing without opening of the casing;

a removable lance comprising a cooperating portion that cooperates with the casing for the assembling and disassembling of the lance onto the casing;

wherein the lance also comprises an abutment which, upon contact with the trigger, prevents the trigger from being separated from the casing;

wherein the lance further comprises a cooperating portion that cooperates with the trigger for locking when it is not operating or unlocking the trigger, wherein the cooperating portion of the lance:

prevents, upon locking when in an inoperative mode, the displacement of the trigger in the actuation direction by mechanical abutment; and releases, during unlocking, the displacement of the trigger in the actuation direction for bringing the ignition abutment and the piezoelectric igniter into contact.

7. The hand tool according to claim 6, wherein the cooperating portion of the lance comprises a rotary ring about the axis of the lance, and the section of which has a blocking portion and an unblocking portion, the blocking portion extending radially beyond the unblocking portion on a fraction of the ring less than 360° so as to come into abutment with a blocking wedge provided on the trigger during locking.

8. A hand tool with an incorporated burner comprising:

a casing;

a burner housed in the casing and connected to an electrically conducting component;

a trigger mounted on the casing and movable along an axis;

an ignition abutment; and a piezoelectric igniter;

wherein the trigger comprises an open actuation housing receiving the piezoelectric igniter;

the actuation housing having an open end facing the ignition abutment so that the piezoelectric igniter is placed facing the ignition abutment and that a displacement of the trigger in an actuation direction forces the piezoelectric igniter against the ignition abutment for producing a spark at the burner via the electrically conducting component; and wherein the trigger and the piezoelectric igniter form a take-down unit, the take-down unit being removable from the casing without opening of the casing; and wherein the casing comprises a stopping wedge, the trigger comprises an operating lock, an instantaneous actuation portion for instantaneous operation of the hand tool and a locking actuation portion for a locking operation of the hand tool;

the actuation of the instantaneous actuation portion driving the operating lock along the axis of displacement of the trigger; and the locking of the actuation portion driving the operating lock into motion towards the stopping wedge and thereby locking the hand tool in an operative state.

* * * * *